US006579160B2

(12) United States Patent
Nanjo et al.

(10) Patent No.: US 6,579,160 B2
(45) Date of Patent: Jun. 17, 2003

(54) HOLDER FOR POLISHED WORK AND MANUFACTURING METHOD THEREOF

(75) Inventors: Motoyuki Nanjo, Mihara (JP); Kouji Uchihata, Mihara (JP); Akihiko Uzawa, Sagamihara (JP); Kuniyuki Kanai, Koza-gun (JP)

(73) Assignees: Sumitomo Bakelite Company Limited, Tokyo (JP); Artlite Kogyo Co., Ltd., Mihara (JP); UTK System Co., Ltd., Sagamihara (JP); C.R.T. Co., Ltd., Koza-gun (JP)

( * ) Notice: Subject to any disclaimer, the term of this patent is extended or adjusted under 35 U.S.C. 154(b) by 0 days.

(21) Appl. No.: 09/900,051

(22) Filed: Jul. 9, 2001

(65) Prior Publication Data

US 2002/0077046 A1 Jun. 20, 2002

(30) Foreign Application Priority Data

Jul. 10, 2000 (JP) ..... 2000-208289

(51) Int. Cl.[7] ..... B24B 5/00
(52) U.S. Cl. ..... 451/291; 451/288; 451/285
(58) Field of Search ..... 451/262, 291, 451/283, 285, 288, 268, 269

(56) References Cited

U.S. PATENT DOCUMENTS

| | | | | | |
|---|---|---|---|---|---|
| 3,813,828 | A | * | 6/1974 | Bennett | 451/292 |
| 4,800,686 | A | * | 1/1989 | Hirabayashi et al. | 451/291 |
| 5,085,009 | A | * | 2/1992 | Kinumura et al. | 451/291 |
| 5,573,448 | A | * | 11/1996 | Nakazima et al. | 451/41 |
| 5,944,591 | A | * | 8/1999 | Chen | 451/290 |
| 6,030,280 | A | * | 2/2000 | Fruitman | 451/291 |
| 6,419,555 | B1 | * | 7/2002 | Goers | 451/41 |

* cited by examiner

*Primary Examiner*—Lee D. Wilson
(74) *Attorney, Agent, or Firm*—Oblon, Spivak, McClelland, Maier & Neustadt, P.C.

(57) ABSTRACT

The inner circumferential surface of through holes in a metal plate is chamfered or put to anchor fabrication and a thermoplastic resin is injection molding to the inner circumferential surface of the through hole thereby forming a resin portion over the entire surface of the through hole and the resin portion is removed by grinding while leaving the peripheral portion of the resin portion thereby forming a polished work holding hole. Thus, when a resin portion is formed to the inner circumference of the holding hole in a polished work holder comprising a metal plate, the production is high and the cost is reduced, and the resin portion is not detached from the bonding portion with no use of the adhesive.

6 Claims, 6 Drawing Sheets

HOLDER FOR POLISHED WORK AND MANUFACTURING METHOD THEREOF

TECHNICAL FIELD

The present invention concerns a holder for a polished work used for holding the polished work when disk-shaped polished works including semiconductor wafers, aluminum disks or glass disks for hard disks, glass substrates for use in liquid crystal displays and disk-shaped ceramics are polished by a surface polishing apparatus, as well as a manufacturing method thereof.

BACKGROUND ART

For example, when disk-shaped polished work comprising, for example, a semiconductor wafer, aluminum disk or glass disk for hard disk, a glass substrate for use in a liquid crystal display and disk-shaped ceramics is polished by a surface polishing apparatus such as a lapping machine, a holder for polished work as shown in FIG. 11 is used for holding the polished work. The holder 30 for the polished work has several to several tens lapped material holding holes 32 for holding the lapped material 31 and has a gear 33 meshing with a sun gear and an internal gear of a surface polishing apparatus.

Known polished work holders can include, for example, metal holders comprising metal plates such as made of SK steels or stainless steels, holders having resin coating applied on the surface of the metal holders (referred to Japanese Published Unexamined Utility Model Application No. 4349/1983) and laminate holders formed by impregnating carbon fibers with resins (Japanese Published Unexamined Patent Application No. 143954/1983). Metal polished work holders comprising metal plate have working life ten times or more the polished work holder comprising resin plates developed subsequently in view of the polishing durability but have a drawback of sometimes damaging the polished work such as cracking or chipping by contact between the metal and the polished work in the work holding hole, which greatly deteriorates the yield of the polished product.

As a countermeasure for preventing such cracking or chipping of the polished work, a resin portion may be formed along the inner circumference of the work holding hole in which the work holding hole is manufactured by grinding a resin plate of a thickness identical with the metal plate, fitting the same to the inner circumference of the work holding hole and the surface of contact between the metal and the resin is secured by an adhesive. The polished work holder has an advantageous effect to some extent in that it can prevent occurrence of flaws such as cracking or chipping to the polished work but it lacks in the bonding reliability and the resin tends to drop easily from the adhesion portion. In addition, it requires a number of complicate manufacturing steps, is poor in the productivity and increases the cost, so that it has not yet been used generally.

Accordingly, this invention intends to provide a method of manufacturing a polished work holder and a polished work holder comprising a metal plate, having high productivity and of a reduced cost when a resin portion is formed to the inner circumference of a holding hole and in which the resin does not drop of the bonding portion without using the adhesive or the like.

DISCLOSURE OF THE INVENTION

In view of the foregoing situations, the present inventors have made an earnest study and, as a result, have accomplished the present invention based on the finding that a polished work holder can be manufactured at a high productivity and at a reduced cost in which resin or resin lamination molding product does not drop off the adhesion portion by providing a metal plate having through holes formed for holding the polished work, chamfering the periphery of the through holes partially or entirely and then injection molding a resin to the chamfered portion and the penetrated portion of the through holes, or providing a plurality of penetrating recesses to the inner surface of the through holes, chamfering protrusions defined by the penetrating recesses partially or entirely or forming unevenness on the lateral surface at the top ends of the protrusions and then injection molding a resin to the penetrating recesses and the penetrated portion of the through holes, or laminate molding a prepreg and pressing the same under heating and pressure, thereby forming a resin or a resin lamination molding product to the formed through holes and then cutting off the same while leaving a required amount of the resin portion to the inner circumferential portion of the through holes.

The invention (1) provides a polished work holder comprising a metal plate in which through holes are fabricated for holding a polished work, wherein the periphery of the through hole is chamfered partially or entirely and the periphery and the inner circumference thereof are coated with a resin or a resin lamination molding product.

The invention (2) provides a polished work holder comprising a metal plate in which through holes are fabricated for holding a polished work, wherein a plurality of penetrating recesses are formed to the inner surface of each of through holes, each of protrusions formed by the penetrating recesses is chamfered partially or entirely or unevenness is formed on the lateral surface at the top end of the protrusion and the periphery and the inner circumference of each of the through holes are coated with a resin or a resin lamination molding product.

The invention (3) provides a method of manufacturing a polished work holder, which comprises attaching, to a molding die, a metal plate having through holes for holding polished works in which the periphery of the through hole is chamfered partially or entirely, injection molding a resin to the through holes including the chamfered portion and then grinding to remove the resin molded to the through holes while leaving a resin portion in a required amount to the inner circumference of the through holes, thereby forming a polished work holding hole.

The invention (4) provides a method of manufacturing a polished work holder which comprises attaching, to a molding die, a metal plate having through holes for holding polished works in which a plurality of penetrating recesses are formed to the inner surface of each of the through holes, chamfering each of the protrusions formed by each of the penetrating recesses partially or entirely or forming unevenness on the lateral surface at the top end of each of the protrusion, injection molding a resin to the through hole portion including the penetrating recess, then grinding to eliminate the resin molded to the through holes while leaving the resin portion in a required amount to the inner circumference of the through holes, thereby forming the work holding hole.

The invention (5) provides a method of manufacturing a polished work holder which comprises chamfering the periphery of through holes fabricated in a metal plate for holding polished work partially or entirely, fitting a thermosetting resin prepreg of a shape conforming to the through hole into the through hole, subsequently, forming a resin lamination molding product over the entire surface of the through holes by pressing under heating and pressure, then grinding to remove the resin lamination molding product while leaving the resin lamination molding product in an amount required for the inner circumference of the through hole thereby forming a polished work holding hole.

The invention (6) provides a method of manufacturing a polished work holder which comprises forming a plurality of penetrating recesses to the inner surface of each of through holes fabricated in a metal plate for holding the polished works, chamfering each of protrusions defined by the penetrating recesses partially or entirely or forming unevenness on the lateral surface at the top end of each of the protrusions, fitting a thermosetting resin prepreg conforming to the shape of the through hole into the through hole, subsequently, forming a resin lamination molding product over the entire surface of the through hole by pressing under heating and pressure and then grinding to remove the resin lamination molding product while leaving a resin lamination molding product in an amount required for the inner circumference of the through hole, thereby forming the polished work holding hole.

DETAILED DESCRIPTION

Then, a polished work holder in a first embodiment of the present invention is to be explained with reference to FIG. 1 to FIG. 6. A polished work holder 10 has several to several tens (18 holes in FIG. 1) of work holding holes 1 for holding polished works (not illustrated), and has a driving gear 5 formed at the outer circumference thereof for meshing with a sun gear and an internal gear of a surface polishing apparatus.

Figure 2:
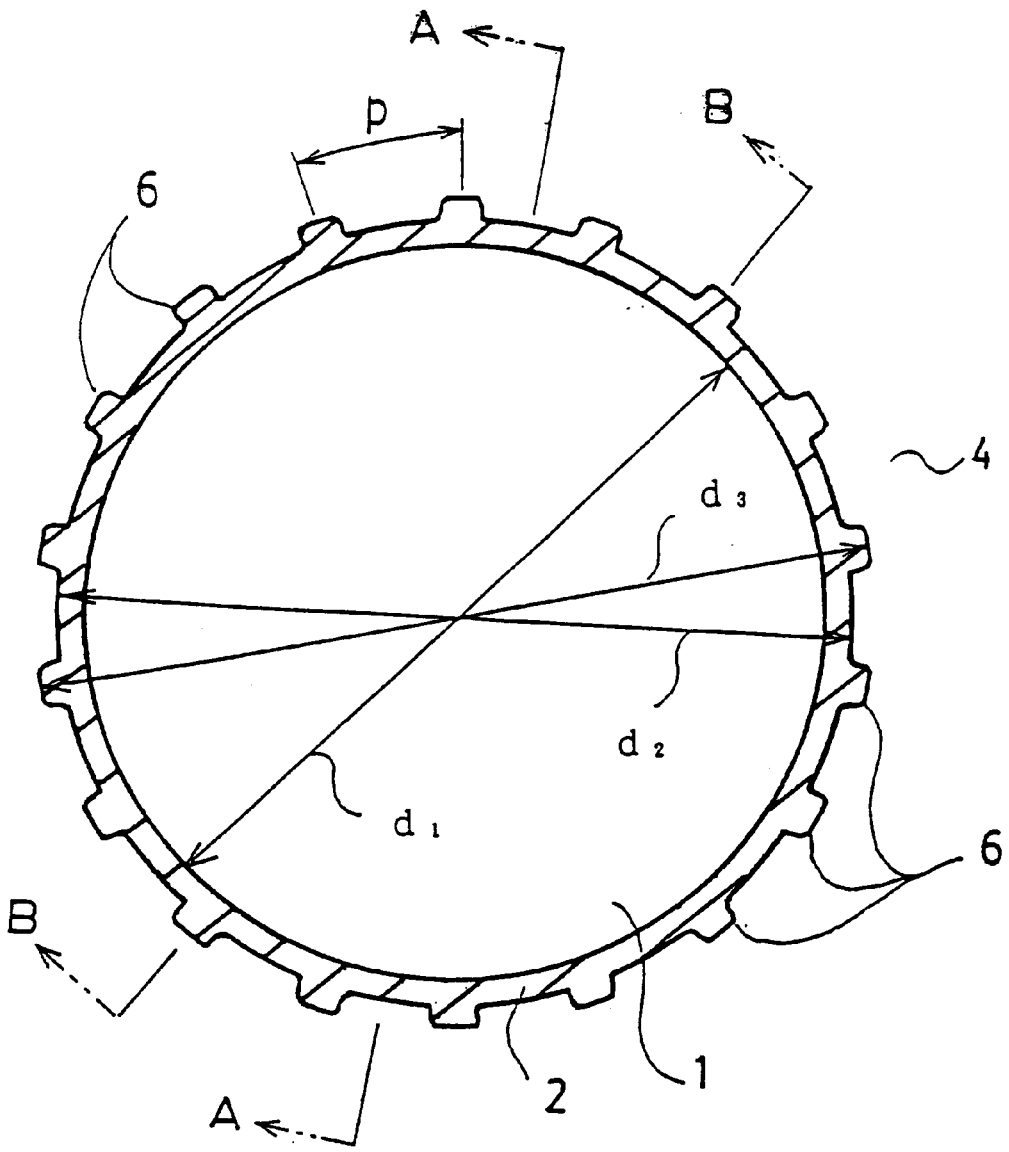
FIG. 2 is an enlarged cross sectional view of one holding hole in FIG. 1.
Figure 3:
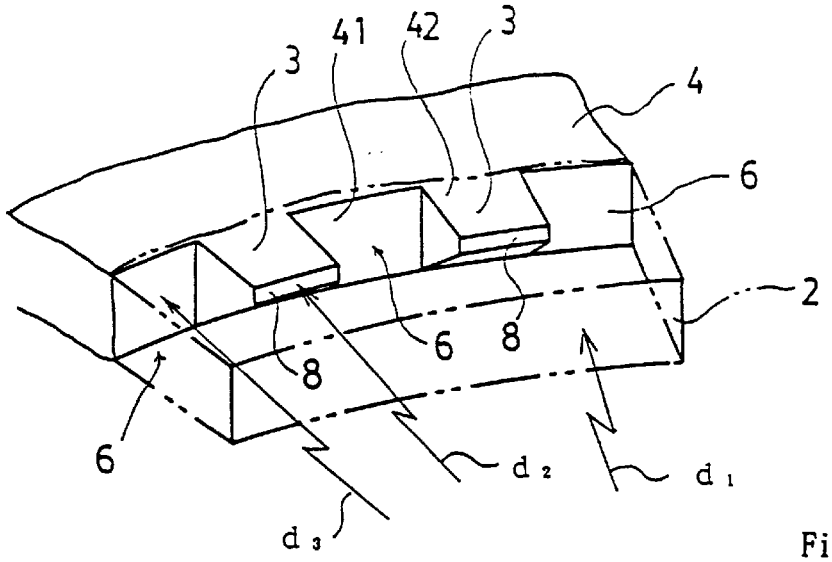
FIG. 3 is a fragmentary view of a through hole before injection molding in the first embodiment.

The work holding hole 1 has a structure in which a periphery 42 and a inner surf ace 41 of a through hole formed in a metal plate 4 are covered with a resin 2 (shown by hatched portion in FIG. 2 and dotted chain portion in FIG. 3). The work holding hole 1 of such a structure is formed as described below. That is, circular through holes each having an inner diameter $d_2$ larger by 2 to 7 mm than a final inner diameter $d_1$ of the work holding hole are formed at first to the metal plate 4. There is no particular restriction on the number of the through holes, which is properly selected from several holes to several tens holes depending on the kind of the polished work. Then, penetrating recesses (hereinafter also referred as "anchor") 6 are formed each at a predetermined pitch p to the inner surface of the circular through hole of the inner diameter $d_2$. The anchor 6 is an optional constituent element in this first embodiment but it is preferably disposed for firmly integrating the resin portion 2 to be injection molded subsequently and the metal plate 4. There are no particular restrictions for the number, the shape of the recess and the recessed depth of the anchor 6, which are selected properly. In FIG. 2, the anchor 6 is disposed by the number of 18, the recess has a trapezoidal shape with a recessed depth of $(d_3-d_2)/2$.

Then, the upper corner or the lower corner on the circumference of the through hole (inner diameter ($d_2$), that is, the upper portion or the lower portion of protrusions 8 formed by a plurality of penetrating recesses are chamfered at 3, 3. This chamfering prevents the resin portion 2 injection molded subsequently from detaching upwardly or downwardly. The chamfering may be formed to the upper corner and/or lower corner on the circumference of the through holes (inner diameter $d_2$). When one of them is chamfered (that is, chamfered only on one side), it is preferably chamfered such that adjacent protrusions 8 and 8 are chamfered one at the upper portion and another at the lower portion alternately for making the resin less detaching from the bonded surface. Each of the chamfering may be disposed continuously over the entire circumference or may be formed not continuously to a portion of the circumference. The chamfered portions 3, 3 may be in any shape, for example, the cross sectional shape of the portion after the chamfering is in a trapezoidal form (FIG. 3), a rectangular form (FIG. 6) and an indefinite shape surrounded with a parabolic curve (not illustrated). Among them, a trapezoidal shape is preferred in view of easy fabrication. When each of the chamfered portions 3, 3 is in the trapezoidal shape, the chamfering depth ($h_1$) is preferably from ⅓ or more to less than ½ for the thickness of the metal plate. Further, when the plate thickness is 0.2 mm or less, chamfering is made only on one side in which the chamfering depth is preferably about from ⅓ or more and less than ½ of the thickness of the metal plate.

Further, there is no particular restriction on the radial length of the chamfered portion and it is preferably about from 0.1 mm to twice of the plate thickness. Since the chamfered portions 3 and 3 are formed with an aim of preventing detachment of the resin portion to be formed, no strict accuracy is required for the surface of the chamfered portion and larger surface roughness is rather preferred for making the adhesion with the resin firm. Further, there is no particular restriction on the chamfering method and a method of using a grinding wheel is suitable since this is most simple and convenient, and requires less cost.

Figure 7:
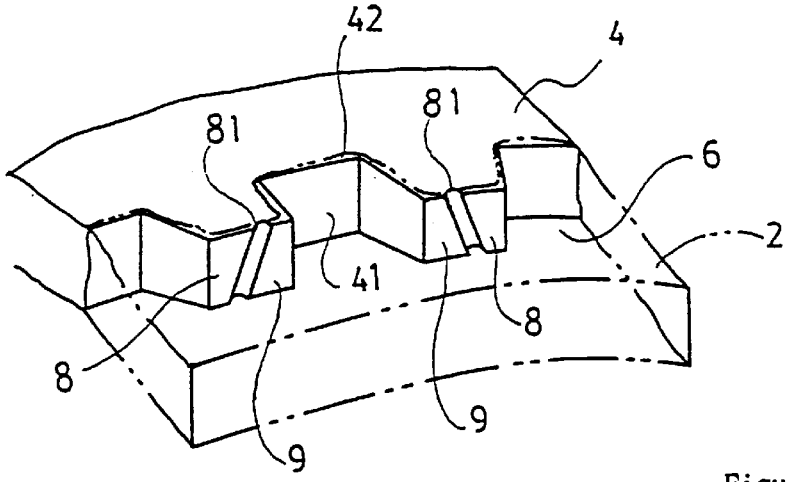
FIG. 7 is an enlarged perspective view before injection molding of a through holes in a second embodiment.
Figure 8:
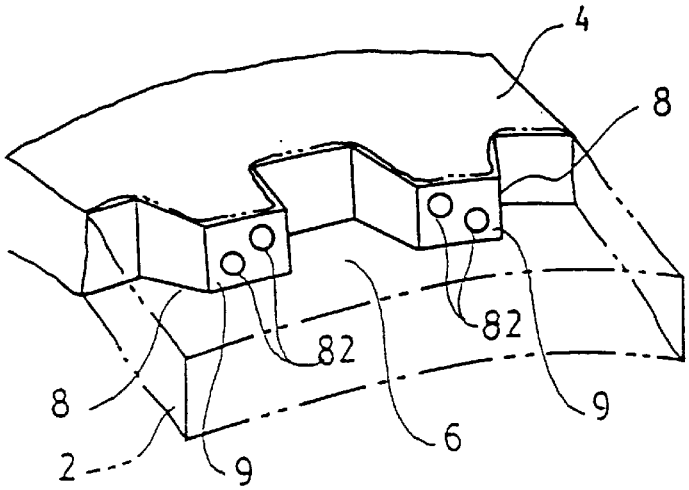
FIG. 8 is an enlarged perspective view before injection molding of another through holes in a second embodiment.
Figure 9:
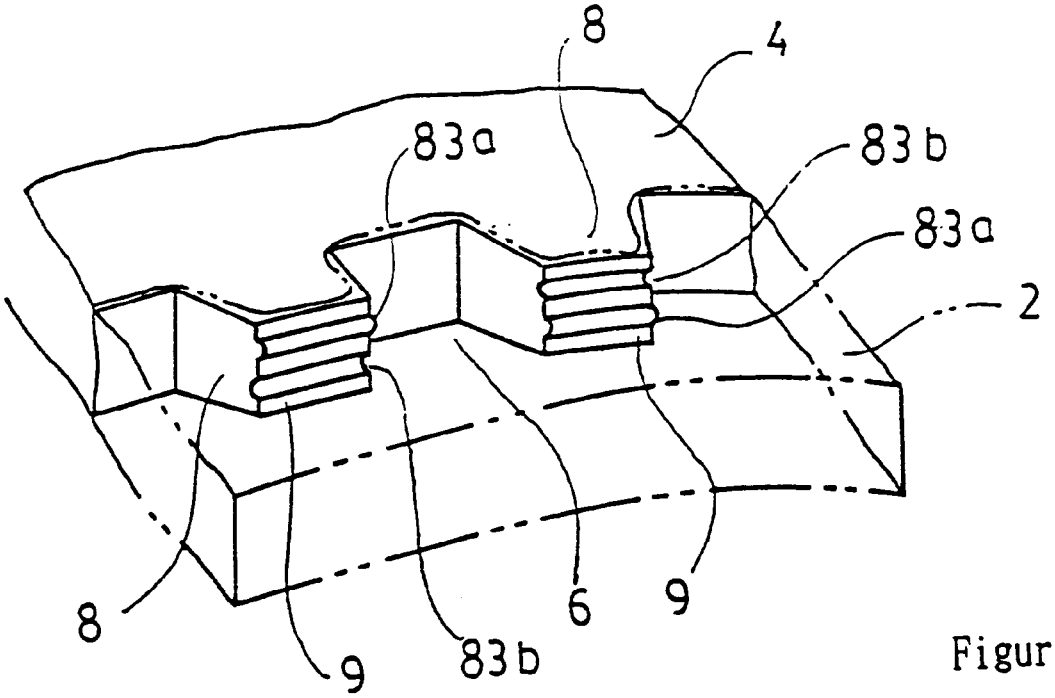
FIG. 9 is an enlarged perspective view before injection molding of other through holes in a second embodiment.

Then, a polished work holder as a second embodiment according to the present invention is to be explained with reference to FIG. 7 to FIG. 9. FIG. 7 is a fragmentary view of a through hole before injection molding, FIG. 8 is a fragmentary view of another through hole before injection molding, and FIG. 9 is a fragmentary view of other through hole before injection molding, respectively. In FIG. 7 to FIG. 9, identical constituent elements with those in FIG. 3 carry the same reference numerals for which explanation is omitted and explanation is to be made mainly for different constitutions. That is, constitutions of FIG. 7 is different from those in FIG. 3 in that the chamfered portion is not present at the periphery of the through hole and an oblique groove 81 is formed on the lateral surface 9 at the top end of a protrusion 8 formed by penetration. The slanting of direction the oblique groove 81 is opposite in the oblique groove 8 on the lateral surface 9 at the top end of an adjacent protrusion 8. By making the slanting direction of the grooves different alternately, the resin less detaches upwardly or downwardly from the adhesion portion of the through hole. The unevenness formed on the lateral surface 9 at the top end of the protrusion 8 is not restricted to the oblique groove 81 but may include other configuration, for example, dimple-shaped unevenness (FIG. 8) or an unevenness (FIG. 9) comprising a combination of protrusions 83*a* and grooves 83*b* disposed laterally. In this second embodiment, the penetrating recesses (anchor 6) are essential constituent factor and the protrusions defined therewith have the unevenness formed on the lateral surface 9 at the top end of the protrusions 8 as shown in FIG. 7 to FIG. 9, and the inner circumference 41 of the through hole is covered with a resin. The resin may be formed not only to the inner circumference 41 of the through hole but also to the periphery 42 on the upper surface or the lower surface of the metal plate in contiguous with the inner circumference 41 as an extremely thin coating. The protrusion 8 may be chamfered partially or entirely (not illustrated). When such chamfering is applied, unevenness on the lateral surface 9 at the top end of the protrusion 8 may be saved.

In the polished work holder according to the present invention, the periphery and the inner circumference of the through holes are coated with a resin or a resin lamination molding product. The inner circumference of the through hole means the inner end face of the through hole and the periphery of the through hole means the vicinity of the upper surface or the lower surface of the metal plates in contiguous with the inner circumference. There is no particular restriction on the resin used and, when the resin coating is manufactured by injection molding a thermoplastic resin is preferred, since the thermoplastic resin has excellent injection moldability. Specifically, wholly aromatic liquid crystal polyester (LCP), polybutylene terephthalate (PBT), polyacetal (POM) and polycarbonate (PC) are preferred in view of the strength, abrasion resistance, chemical resistance and flowability upon molding.

For the resin, any of straight resins (with no reinforcement) or reinforced resins reinforced with short fiber glass may be used. Straight resin are used in a case where it is necessary to prevent scattering of glass powder. Further, polypropylene (PP) is usable since this is a most popularized resin and has excellent property in view of moldability, chemical resistance and abrasion resistance although the applicable range is limited in view of the strength. In addition polyphenylene sulfide (PPS) can be used. Further, in the present invention, the resin lamination molding product is prepared by impregnating a woven fabric or non-woven fabric as a substrate with a matrix thermosetting resin to form a prepreg lamination molding product, which is then pressed under heating and pressure. The matrix thermosetting resin can include, for example, epoxy resin, phenolic resin and diallyl phthalate resin. The substrate to be impregnated with the thermosetting resin can include glass fibers, polyester fibers such as liquid crystal aromatic polyester fibers, aramid fibers, cotton and cellulose fibers. The resin content of the prepreg prepared by impregnating the substrate with the matrix thermosetting resin has no particular restriction and may be properly controlled depending on the thickness of the resin lamination molding product required after molding and the impregnation amount is preferably from 30 to 70%.

Figure 10:
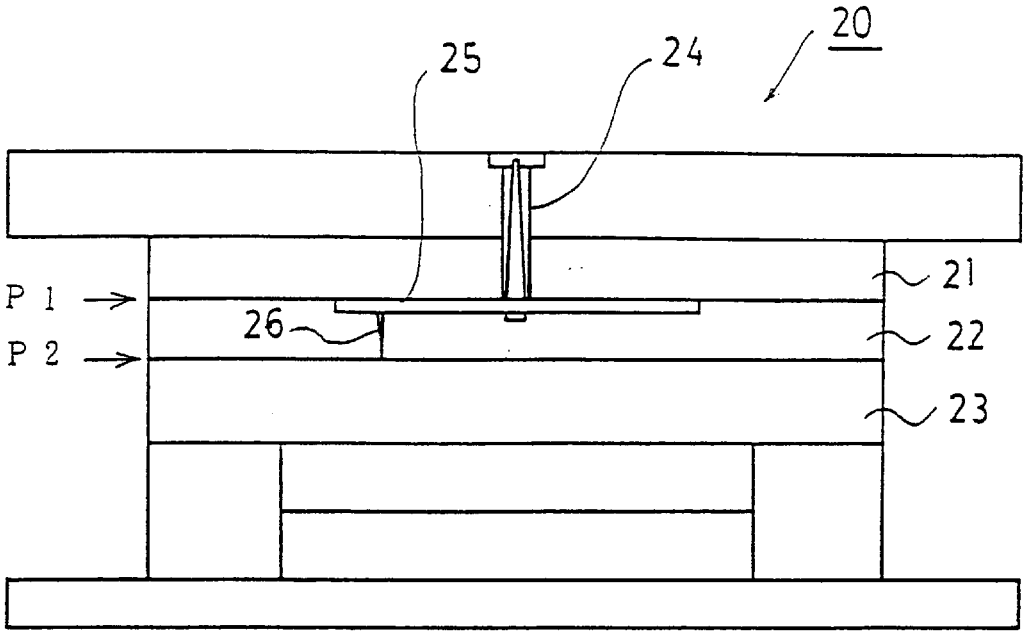
FIG. 10 is a front elevational view in cross section for a portion of an injection molding die.
Figure 11:
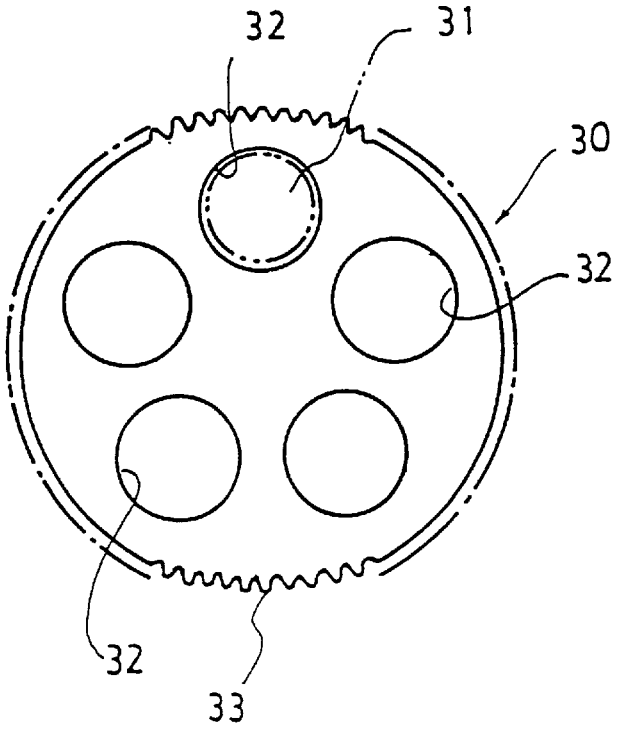
FIG. 11 is an explanatory view of an existent polished work holder.

Then, a first method of manufacturing a polished work holder 10 in the first embodiment according to the present invention is to be explained with reference to FIG. 10. FIG. 10 is a front elevational view in cross section for a portion of an injection molding die. A polished work holder 10 is a metal plate 4 in which the periphery of through holes each of an inner diameter $d_2$ is partially or entirely chamfered and the holder is mounted to an injection molding die 20 and a resin is injection molded to the portion of the through holes including the chamfered portions 3, 3. The injection molding die 20 has a three plate structure comprising a fixed die 21, a core die 22 and a movable die 23. For example, a spool 24 is formed at the center of the fixed die 21 and a runner 25 and a gate for injecting resin (not illustrated) is formed to the core die 22. A cavity is defined with the core die 22, the movable die 23 and the through hole of a metal plate put between them. Pin point gates 26 are disposed at three positions to each of the through holes (that is, cavity) to improve the resin injection. In the drawing, P1 and P2 denote parting lines and the metal plate 4 is attached to the parting line P2. There is no particular restriction on the resin to be injection molding but a thermoplastic resin is preferred in view of easy injection molding. Specifically, those thermoplastic resins described previously can be used.

The resin is molded to the inner circumference or the inner circumference and the periphery of the through hole of the metal plate by injection molding. The resin molded to the inner circumference of the through hole is removed by grinding while leaving the resin portion at an appropriate width to the inner circumference of the through hole thereby forming a polished work holding hole. The inner diameter is set some what larger than the outer diameter of the polished work so as to make the rotational motion smooth during the polishing step of the polished work. With such a constitution, direct contact between the metal plate and the polished work during polishing process can be avoided to greatly reduce the occurrence of flaws. Further, since the metal plate after use can be re-utilized by removing the resin, the method is excellent in cost performance.

The method of manufacturing the polished work holder of the second embodiment is practiced by attaching the metal plate shown in FIG. 7 to FIG. 9 to the molding die and injection molding the resin to the through holes including the penetrating recesses and the method is also conducted in the same manner as the method described above. Further, in a case where the resin is molded over the entire surface of the through holes of the metal plate by injection molding, the polished work holding holes are formed in the same manner by grinding to remove the resin while leaving the resin portion at an appropriate width to the inner circumference of the through holes.

Then, a second method of manufacturing the polished work holder according to the present invention is to be explained. At first, in a metal plate formed with through holes for holding the polished work, the periphery of the through hole is chamfered partially or entirely to obtain a chamfered through hole as shown in FIG. 3 and then a thermosetting resin prepreg laminated by an appropriate number of sheets, fabricated into the shape of the through hole is fitted into the through hole, appending a releasable films on upper and lower surfaces and then forming the resin lamination molding product to the entire surface of the through hole by hot pressing under heating and pressure. In this state, the through hole is completely closed with the resin lamination molding product and the resin lamination molding product is coated also to the chamfered portion at the periphery of the through hole. Then, the resin lamination molding product closing the through hole is removed by grinding while leaving a necessary amount of the resin lamination molding product at the inner circumference of the through hole to form a polished work holding hole of an inner diameter $d_1$.

Further, also for the through hole formed with penetrating recesses, for example, as shown in FIG. 7 to FIG. 9, a resin lamination molding product can also be formed to the through hole by the same method as described above and a polished work holding hole of an inner diameter $d_1$ can be formed to the metal plate. According to the second manufacturing method, while the number of the steps increases slightly, detachment of the resin lamination molding product from the adhesion portion can be suppressed by a simple and convenient method without using adhesives.

EXAMPLE

The present invention is to be explained more in details with reference to examples but they are merely examples and no way restrict the present invention.

Example 1

Figure 1:
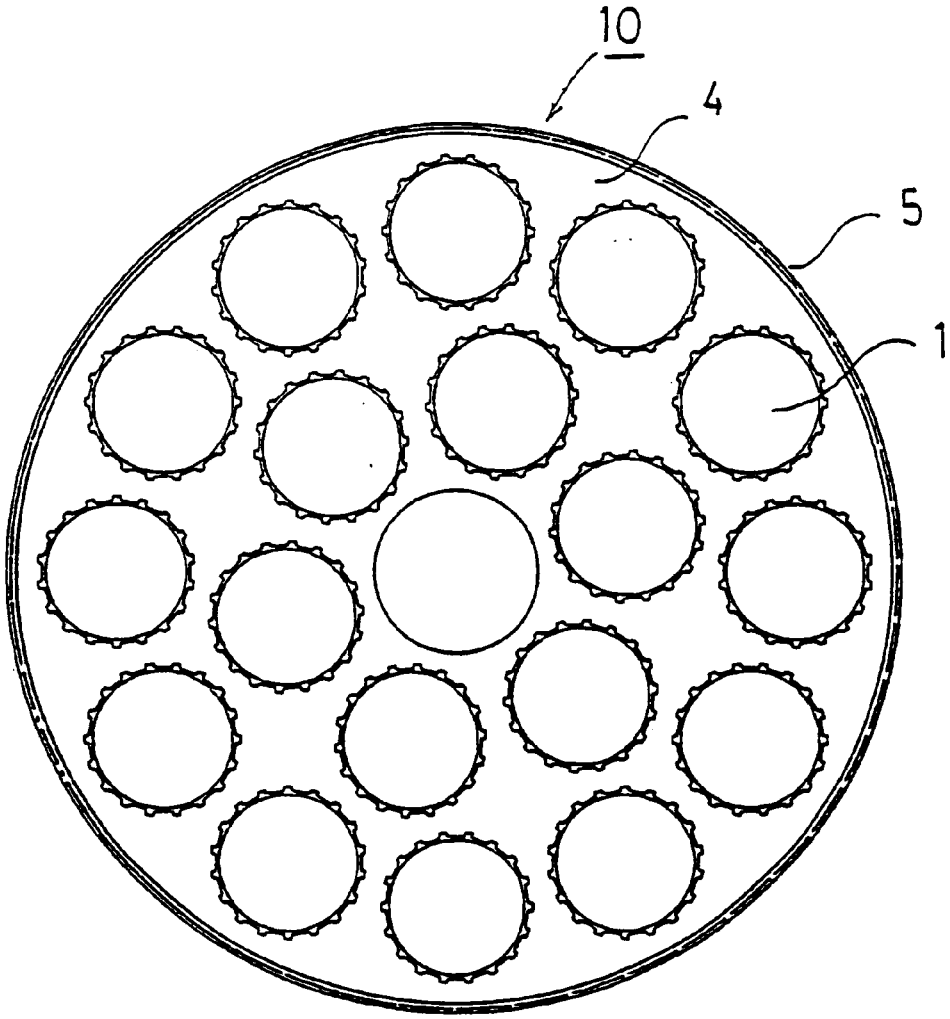
FIG. 1 is a plan view of a polished work holder in a first embodiment of this invention.
Figure 4:
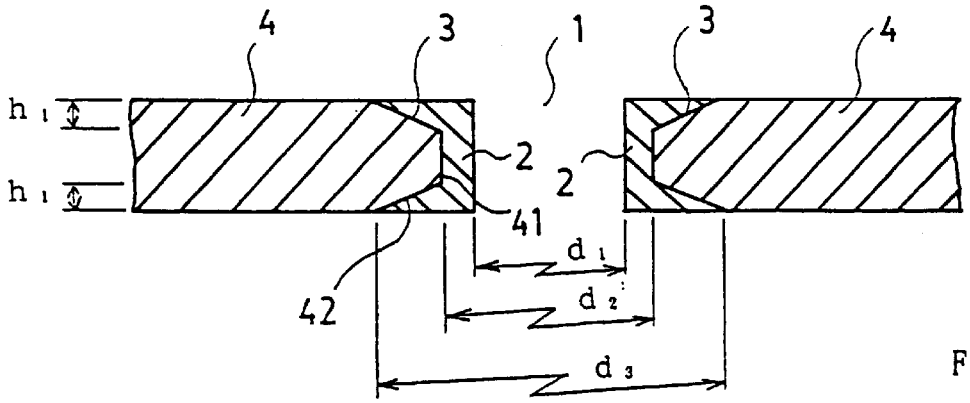
FIG. 4 is an end view along line A—A in FIG. 2.
Figure 5:
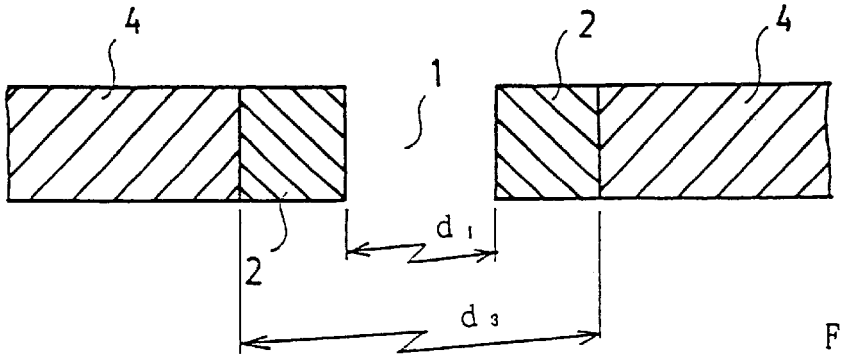
FIG. 5 is an end view along line B—B in FIG. 2.
Figure 6:
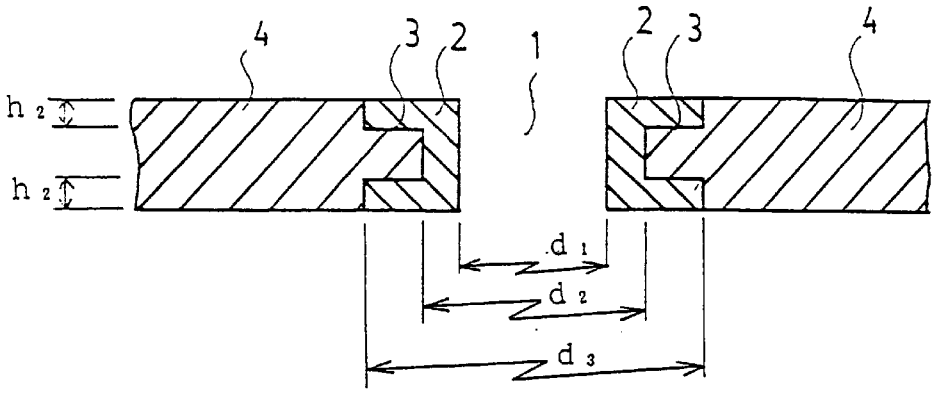
FIG. 6 is a view illustrating another embodiment of a chamfered portion in FIG. 4.

A stainless steel disk plate of 0.5 mm thickness formed with teeth by the number of 200 has an outermost diameter of 427 mm and a diameter at the bottom of the teeth of 417 mm, in which 18 through holes are fabricated. Each through hole had a size of 70 mmϕ ($d_2$) with anchors being formed by the number of 18 at the periphery thereof (FIG. 1 and FIG. 2). The upper corner and the lower corner of the through hole (excepting the anchor) were chamfered by a grinding wheel. The cross sectional shape after the chamfering was as shown in FIG. 3 to FIG. 5 in which the chamfering depth ($h_2$) was about 0.2 mm. Then, the metal plate was attached to the molding die. In FIG. 8, it was attached to the molding die such that the metal plate is situated at P2, that is, sandwiched between the core die and the movable die. The wholly aromatic liquid crystal polyester ("Sumica Super LCP-E7008": manufactured by Sumitomo Chemical) was used and injection molded to obtain a polished work holder 1. IS450F manufactured by Toshiba Kikai was used as an injection molding machine and injection molding was conducted under the molding conditions at a cylinder temperature of 360° C., a die temperature of 80° C. and for a molding time of 30 sec/1 cycle.

Example 2

A polished work holder 2 was obtained in the same method as in example 1 except for using polycarbonate ("YupironS-3000"; manufactured by Mitsubishi Engineering Plastics Co.) instead of the wholly aromatic liquid crystal polyester ("Sumica Super-LCP-E7008"; manufactured by Sumitomo Chemical Co.). Molding conditions were at a cylinder temperature of 280° C., at a die temperature of 65° C. and for a molding time of 30 sec/1 cycle.

Example 3

A polished work holder 3 was obtained in the same method as in Example 1 except for using polybutylene terephthalate ("Planack BT-1000"; manufactured by Dainippon Ink Chemical Co.) instead of the wholly aromatic liquid crystal polyester ("Sumica Super-LCP-E7008"; manufactured by Sumitomo Chemical Co.). Molding conditions were at a cylinder temperature of 230° C., at a die temperature of 65° C. and for a molding time of 30 sec/1 cycle.

Example 4

A polished work holder 4 was obtained in the same method as in Example 1 except for using polyphenylene sulfide ("Daicomp FZ1130"; manufactured by Dainippon Ink Chemical Co.) instead of the wholly aromatic liquid crystal polyester ("Sumica Super-LCP-E7008"; manufactured by Sumitomo Chemical Co.). Molding conditions were at a cylinder temperature of 320° C., at a die temperature of 130° C. and for a molding time of 30 sec/1 cycle.

Example 5

A polished work holder 5 was obtained in the same method as in Example 1 except for using polyacetal ("Juracon M-450-44"; manufactured by Polyplastics Co.) instead of the wholly aromatic liquid crystal polyester ("Sumica Super-LCP-E7008"; manufactured by Sumitomo Chemical Co.). Molding conditions were at a cylinder temperature of 200° C., at a die temperature of 75° C. and for a molding time of 30 sec/1 cycle.

Example 6

A polished work holder 6 was obtained in the same method as in Example 1 except for using polypropylene ("Nobren AX568"; manufactured by Sumitomo Chemical Co.) instead of the wholly aromatic liquid crystal polyester ("Sumica Super-LCP-E7008"; manufactured by Sumitomo Chemical Co.). Molding conditions were at a cylinder temperature of 180° C., at a die temperature of 50° C. and for a molding time of 30 sec/1 cycle.

Example 7

Bisphenol epoxy resin ("AER8011"; manufactured by Asahi Chiba Co.) was used as a matrix resin and impregnated into a glass fiber substrate ("KS1220"; manufactured by Kanebo Co.) and dried to prepare a prepreg such that the thickness after molding was 0.1 mm. It was punched out to a shape conforming the through hole of a metal plate, stacked by five sheets and fitted into the through hole which was chamfered in the same shape as that in Example 1. Then, releasable films were appended on upper and lower surfaces thereof, put between two SUS plates, inserted in a molding press and a resin lamination molding product was formed under heating and pressure to the entire surface of the through hole. The resin lamination molding product formed so as to close the through hole was removed by grinding while leaving the resin lamination molding product at an appropriate width to the periphery of the through hole and a work holding hole was formed to obtain a polished work holder 7.

Example 8

A phenol resin (molar ratio 1.2, ammonia catalyst used; manufactured by the applicant's company) was used as a matrix resin and impregnated into a cotton woven fabric substrate ("BC-500E"; manufactured by Nomura Kogyo Co.) and dried to prepare a prepreg such that the thickness after the molding was 0.1 mm. A work holding hole was formed subsequently by the same methods as those in Example 7 to obtain a polished work holder 8.

Example 9

A diallyl phthalate resin ("DT-170"; manufactured by Toto Kasei Co.) was used as a matrix resin and impregnated into a polyester woven fabric substrate ("T-11263"; manufactured by Teijin Co.) and dried to prepare a prepreg such that the thickness after the molding was 0.1 mm. A work holding hole was formed subsequently by the same methods as those in Example 7 to obtain a polished work holder 9.

Comparative Example 1

A polished work holder 10 was obtained in the same method as in Example 1 by using a metal plate not chamfered at the periphery of the through holes, using polyacetal ("Juracon M-450-44"; manufactured by Polyplastics Co.). The molding conditions were at a cylinder temperature of 200° C., at a die temperature of 75° C. for a molding time of 30 sec/1 cycle.

The polished work holders 1–10 obtained by the methods described above were stacked such that they were quite at an identical position and a through hole of 66 mmϕ was fabricated to the center of the resin portion by using a milling machine to form polished work holding holes. The polished work holders 1–10 were served to the polishing test shown below.

Polishing Test

Aluminum disks were polished by 280 batches repetitively using each one of the polished work holders and then the test was terminated and the state of the resin portion in the polished work holding holes and the appearance of the polished product were microscopically observed. "FGL-3700" (manufactured by Fujimi Incorporated) was used as the polishing solution.

As a result of the polishing test, no cracking and chipping were observed in the polished products and no scratches were observed. The result of observation for the resin portion of the polished work holder is shown in Table 1. The overall evaluation in the result of Table 1 was for the relative judgement of practical usefulness in this application use. Even those with the evaluation by the symbol "Δ", can be used practically to an application use with less load,

TABLE 1

| | Overall judgement | Result of observation |
|---|---|---|
| Example 1 | ◎ | no change |
| Example 2 | ○ | clouded discoloration, corner sagged in all 18 holes |
| Example 3 | ○ | no change |
| Example 4 | ○ | cracks in four holes (no detachment) |
| Example 5 | ◎ | no change |
| Example 6 | Δ | weaving deformation in 18 holes |
| Example 7 | ◎ | no change |
| Example 8 | ◎ | no change |
| Example 9 | ◎ | no change |
| Comp. Example 1 | X | detached at 121th batch and primary test was interrupted. Positional displacement in upper/lower direction for 6 holes |

*In overall judgement,
◎ means very good,
○ means good,
Δ means normal,
X means bad.

Industrial Application

In a metal plate in which through holes are fabricated for holding polished works as a polished work holder according to the present invention, since the periphery of the through holes chamfered partially or entirely and the periphery and the inner circumference thereof are covered with a resin or a resin lamination molding product, or a plurality of anchors are disposed to the inner surface of the through hole and protrusion formed by the anchors are chamfered partially or entirely and the periphery and the inner circumference of the through holes are coated with a resin or a resin lamination molding product, the polished work is not damaged and the resin or the resin lamination product is not detached when the polished work is polished. Further, even if the holder can no more be used by the abrasion of the resin portion, since it can be re-utilized by removing the resin portion, it is useful in view of cost and in view of resource saving.

What is claimed is:

1. A polished work holder comprising a metal plate in which through holes are fabricated for holding a polished work, wherein the periphery of the through hole is chamfered partially or entirely and the periphery and the inner circumference thereof are coated with a resin or a resin lamination molding product.

2. A polished work holder comprising a metal plate in which through holes are fabricated for holding a polished work, wherein a plurality of penetrating recesses are formed to the inner surface of each of through holes, each of protrusions formed by the penetrating recesses is chamfered partially or entirely or unevenness is formed on the lateral surface at the top end of the protrusion and the periphery and the inner circumference of each of the through holes are coated with a resin or a resin lamination molding product.

3. The polished work holder as defined in claim 1 or 2, wherein the resin is a thermoplastic resin.

4. The polished work holder as defined in claim 1 or 2, wherein the resin is a material selected from the group consisting of a wholly aromatic liquid crystal polyester (LCP), polybutylene terephthalate (PBT), polyacetal (POM) and polycarbonate (PC).

5. The polished work holder as defined in claim 1 or 2, wherein the resin is a reinforced resin reinforced with short fiber glass or a straight resin with no enforcement.

6. The polished work holder as defined in claim 1 or 2, wherein the resin lamination molding product is formed by pressing under heating and pressure a lamination product of a prepreg in which a matrix resin thermosetting resin is impregnated into a woven fabric or non-woven fabric as a substrate.

* * * * *